United States Patent [19]

Westerman

[11] 4,080,757

[45] Mar. 28, 1978

[54] DOOR LATCH

[76] Inventor: Floyd Westerman, 3421 Stewarton Dr., Richmond, Calif. 94803

[21] Appl. No.: 725,102

[22] Filed: Sep. 20, 1976

[51] Int. Cl.[2] ..... E05D 17/00

[52] U.S. Cl. ..... 49/322; 292/166; 292/171; 292/173; 292/DIG. 36

[58] Field of Search ..... 292/35, 38, 40, 143, 292/166, 171, 173, DIG. 36; 49/322, 450, DIG. 51

[56] References Cited

U.S. PATENT DOCUMENTS

| | | | |
|---|---|---|---|
| 775,186 | 11/1904 | Lovelace | 292/173 X |
| 1,113,667 | 10/1914 | Mahaj | 49/322 X |
| 1,156,632 | 10/1915 | Schoenherr | 292/166 X |
| 1,215,752 | 2/1917 | Walraven | 292/143 |
| 1,470,382 | 10/1923 | Lance | 292/40 |
| 1,474,158 | 11/1923 | Moore | 292/173 |
| 2,556,361 | 6/1951 | Coleman | 292/173 |
| 3,543,441 | 12/1970 | La Porte | 49/450 |
| 3,788,678 | 1/1974 | Switzgable | 49/450 X |

FOREIGN PATENT DOCUMENTS

| | | | |
|---|---|---|---|
| 247,856 | 12/1960 | Australia | 292/DIG. 36 |

*Primary Examiner*—Roy D. Frazier
*Assistant Examiner*—Rodney H. Bonck

[57] ABSTRACT

The invention relates to a safety latch assembly for a warehouse type door that has rollers riding in a vertical guide track, such track having latching holes at various points along its length. The latch assembly has a latch pin with a roller end spring biased toward the track, and rides on the track with the door until it comes into latching engagement with one of the aforementioned holes, and locks the door into its current position. Withdrawing the latch pin from the hole resets the bias spring as the door becomes unlocked.

1 Claim, 3 Drawing Figures

DOOR LATCH

The invention relates to door latches, and in particular to a latch assembly for warehouse type doors which open and close vertically.

There exists in current counter balanced door assemblies, a reliance on the balancing mechanism to maintain the door in its open position. Should the balancing mechanism fail, the door, especially one which opens and closes vertically, will fall and become a danger to anyone or anything below.

Among the objects of my invention are:

(1) To provide a novel and improved door latch assembly;

(2) To provide a novel and improved door latch assembly for a vertically adjustable door;

(3) to provide a novel and improved door latch assembly which can be operated at any elevation.

Additional objects of my invention will be brought out in the following description of the same, taken in conjunction with the accompanying drawings where;

Figure 1:
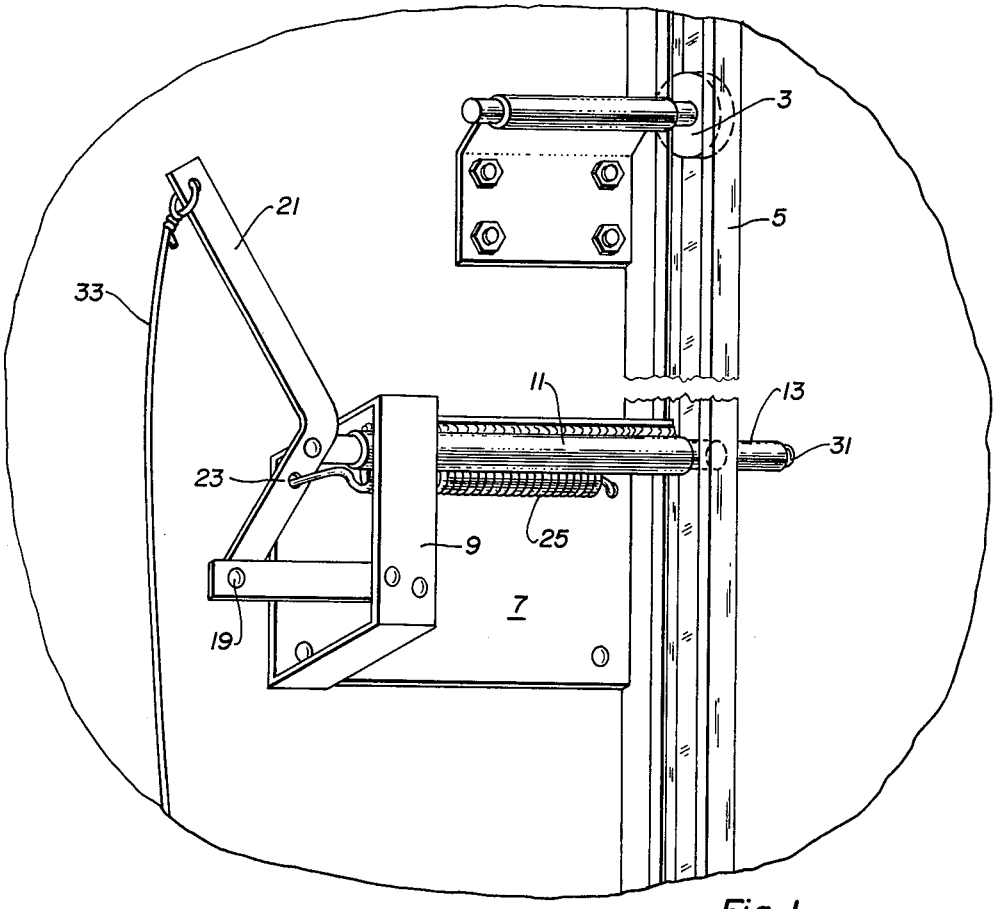
FIG. 1 is a three-dimensional view depicting the invention installed adjacent a guide track.
Figure 2:
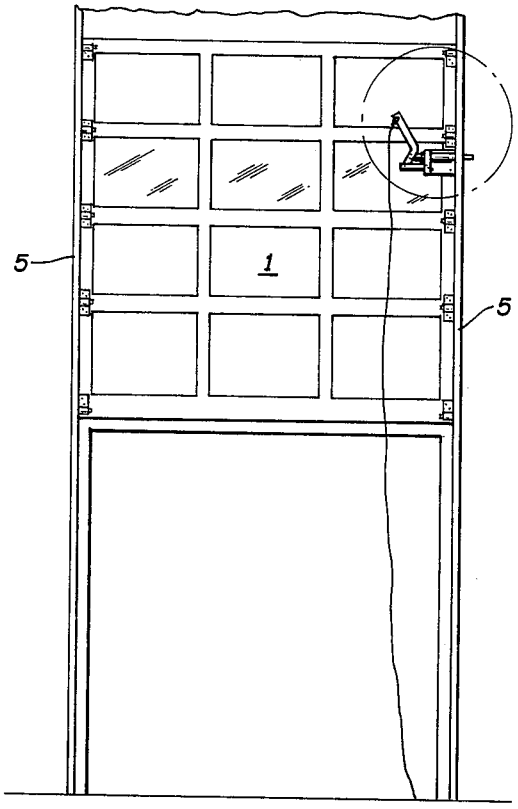
FIG. 2 is a front view in elevation depicting the invention installed on a warehouse type door in its open position.
Figure 3:
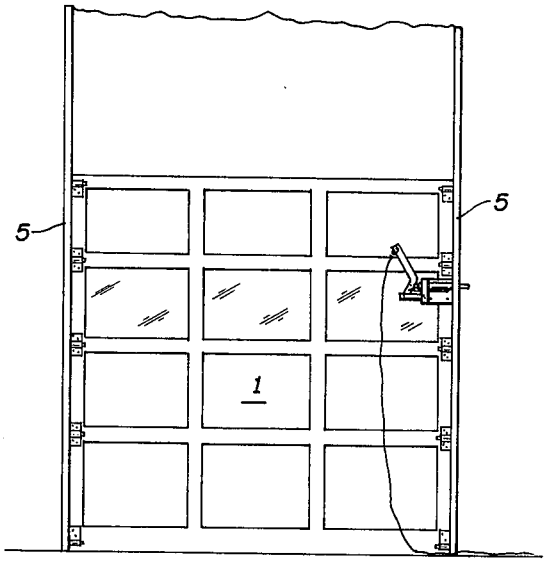
FIG. 3 is a front view in elevation depicting the invention installed on a warehouse type door in a closed position.

Referring to the drawings for details of my invention in its preferred form, the same is depicted installed on a door 1 of the warehouse type having rollers 3 riding in a vertical track 5 along each vertical side of the door opening.

A safety latch assembly 7 is affixed to the door adjacent a vertical end thereof and comprises a mounting bracket 9 with a tubular member 11 for slidably supporting a latch pin 13 for movement toward the track 5 from a nonlatching position.

Such bracket also provides support 19 for pivotally mounting a lever 21 which is also pivotally connected to the end of the latch pin 13 opposite the latching end, and at a point 23 on the lever 21 intermediate the support 19 and its connection to the latch pin, a biasing spring 25 is hooked, with the other end of the spring being anchored to the bracket with the spring in tension.

With the latch assembly so constructed and affixed to the door, the latch pin will ride the proximate track unless in the course of such movement, it encounters a hole in the track, in which case the bias spring 25 will cause the pin 13 to latch and the door will no longer be movable until the latch is withdrawn.

The guide track 5 is provided with such a hole in alignment with the latch pin, when the door is in its fully open position, and thus will latch when the door has reached this position. Thus, the door can no longer accidently drop upon failure of the mechanism which would normally hold the door open.

A similar hole in alignment with the latch pin in the fully closed position, may also be provided, in which case the door will be latched to secure it in its closed position.

A ball 31 anchored rotatably within the latching end of the pin 13 facilitates movement of the biased latch pin along the vertical track when opening and closing the door.

As can be readily seen, all that is needed to unlock the door from any position that it might be latched into, is a simple activation of the lever arm 21 to withdraw the latch pin 13 from the latching hole in the guide rail 5. This may even be accomplished with the aid of a cord or cable 33 hanging from the free or handle end of the lever arm which when pulled will rotate the lever about its pivotal support 19 to withdraw such pin.

Accordingly, I have illustrated and described my invention in its preferred form, and it will be appreciated that the same is subject to alteration and modification without departing from the underlying principles involved, and I accordingly do not desire to be limited in my protection to the specific details illustrated and described except as may be necessitated by the appended claims.

I claim:

1. In combination a warehouse type door having rollers riding in guide tracks installed to each vertical side of the door opening, for use in raising said door from a down closing position to an up open position, means for normally resisting downward movement of said door from its up open position, and a safety latch assembly affixed to said door adjacent a verticle edge thereof, said latch assembly comprising a mounting bracket, a latch pin, means on said bracket for slidably supporting said latch pin for movement towards said track from a nonlatching position with its latching end in proximity to the proximate edge of said door to a position with its latching end adapted to enter an aligned hole in the adjacent track, means normally biasing said latch pin toward its latching position whereby said latch pin will ride with its latching end in engagement with the adjacent track as said door is raised or lowered until it should align with a hole in said track, said track having such hole in line with said latch pin to receive said latch pin when said door in in its open position to function as a safety support for said door in the event of failure of said normal restraining means, said mounting bracket comprising a mounting plate and laterally extending mounting flange, a tubular member welded to the underside of said flange for slidably supporting said latch pin, a right angle component connected at its lower edge to said mounting plate and its upper edge to said flange to define a rectangular framework, a lever support arm affixed to a vertical section of said right angle component and having a free extremity, with the lower end of said lever arm pivotally connected to the free extremity of said lever support arm, said means normally biasing said latch pin toward its latching position including a spring anchored under tension at one end to said lever at an intermediate point thereof, and at its other end to said bracket, said lever terminating in a free end above said intermediate point and beyond the pivotal connection of its lower end, to permit of a downward motivating force to said lever to rotate said lever about said pivotal connection to withdraw said latch pin from its latched position.

* * * * *